United States Patent [19]

Widmyer

[11] 4,109,723

[45] Aug. 29, 1978

[54] THERMAL OIL RECOVERY METHOD

[75] Inventor: Richard H. Widmyer, Houston, Tex.

[73] Assignee: Texaco Inc., New York, N.Y.

[21] Appl. No.: 791,801

[22] Filed: Apr. 28, 1977

[51] Int. Cl.[2] ..... E21B 43/24

[52] U.S. Cl. ..... 166/303; 166/263; 166/306

[58] Field of Search ..... 166/269, 302, 303, 306, 166/263, 314

[56] References Cited

U.S. PATENT DOCUMENTS

| | | | |
|---|---|---|---|
| 2,365,591 | 12/1944 | Ranney | 166/306 X |
| 3,180,414 | 4/1965 | Parker | 166/303 X |
| 3,259,186 | 7/1966 | Dietz | 166/263 |
| 3,292,702 | 12/1966 | Boberg | 166/303 |
| 3,358,762 | 12/1967 | Closmann | 166/303 |
| 3,467,191 | 9/1969 | Van Daalen et al. | 166/269 |
| 3,707,189 | 12/1972 | Prats | 166/263 |
| 3,768,559 | 10/1973 | Allen et al. | 166/303 X |
| 3,924,683 | 12/1975 | George et al. | 166/303 |
| 3,983,939 | 10/1976 | Brown | 166/269 |
| 4,026,359 | 5/1977 | Closmann | 166/306 X |

*Primary Examiner*—Stephen J. Novosad
*Assistant Examiner*—George A. Suchfield
*Attorney, Agent, or Firm*—Carl G. Ries; Thomas H. Whaley; Jack H. Park

[57] ABSTRACT

Heavy or viscous oils may be recovered from subterranean deposits by one or more wells each of which is provided with at least two separate communication means from the surface of the earth, one in fluid communication with the upper part of the formation and the other well being in fluid communication with the lower part of the formation, each of said communication means being completed so as to permit injection of steam or mixtures of steam and other materials into the formation and production of heated viscous petroleum therefrom. The oil recovery process comprises several separate phases of operation. In the first, steam is injected into the formation using both communication means simultaneously for a period of time followed by a soak period if desired, followed by production of heated oil from both parts of the formation using both communication means simultaneously. In the second phase, steam is injected into only one of the communication means, which may be the one in communication with either the top or bottom part of the formation, and oil production is taken from the other communication means. This is followed by a reversal of injection-production sequences, the process effectively pressure pulsing the formation to improve the distance into the formation that the push-pull steam injection process is effective.

10 Claims, 1 Drawing Figure

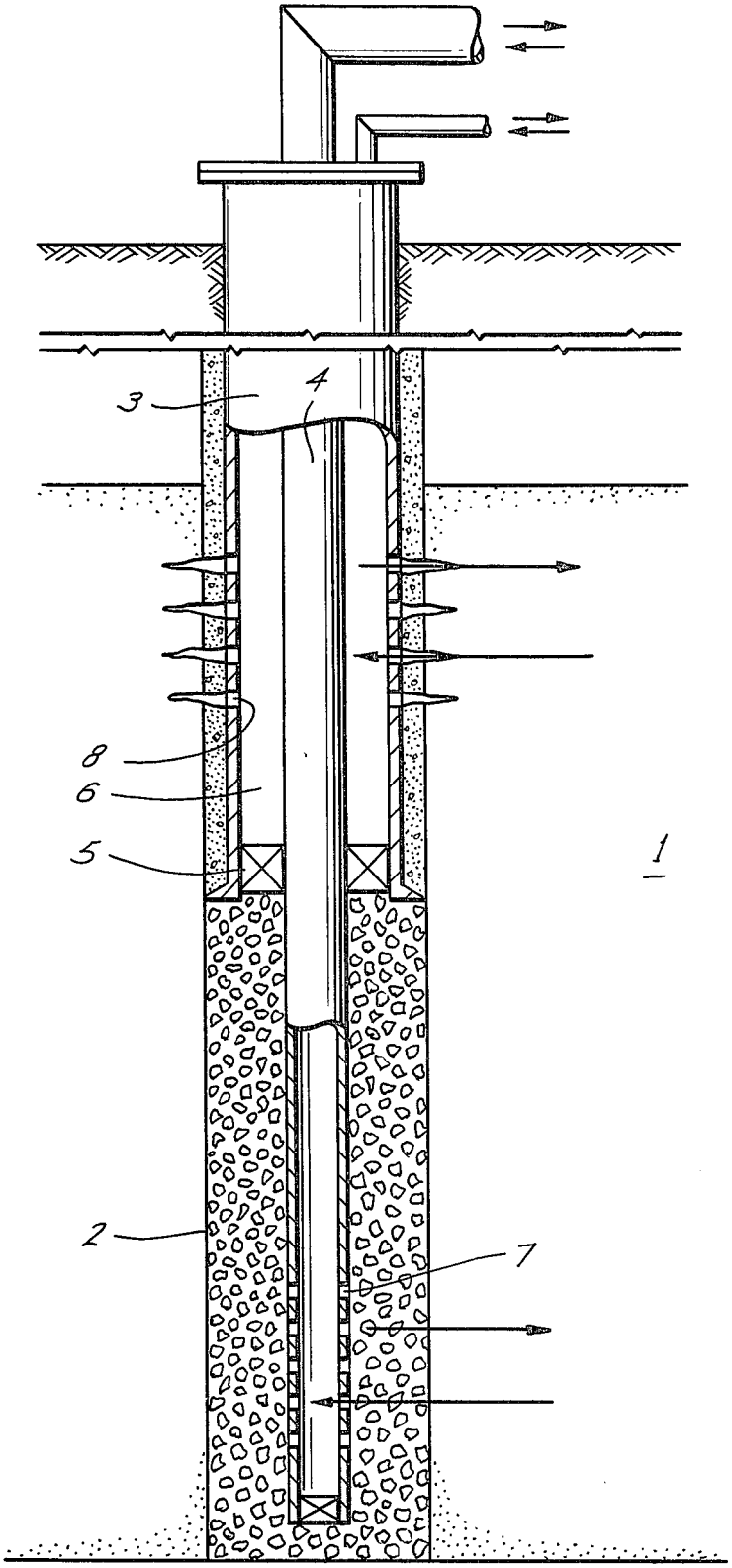
3
4
8
6
5
1
2
7

THERMAL OIL RECOVERY METHOD

BACKGROUND OF THE INVENTION

1. Field of the Invention

This invention pertains to a process for recovering viscous petroleum from a subterranean, viscous petroleum-containing formation. More particularly, this invention is concerned with a particular method for injecting steam into a subterranean viscous petroleum-containing formation by a single well push-pull method in which steam injection and oil production occurs in the same well using a pressure pulsing technique to stimulate production at greater distances in the formation.

2. Description of the Prior Art

Many petroleum reservoirs have been discovered which contain vast quanities of petroleum, but little or no petroleum has been recovered from many of them because the petroleum present in these reservoirs is so viscous that it is essentially immobile at reservoir conditions, and little or no petroleum flow will occur into a well drilled into the formation even if a natural or artificially induced pressure differential exists between the formation and the well. Recovery of such viscous oil can sometimes be accomplished by solvent means, but the cost of solvent flooding is usually excessive in relation to the petroleum production obtainable thereby. Thermal stimulation has been effective in some formations, and generally involves injecting steam into one or more wells and taking production of petroleum heated by the steam from the same or a remotely located well.

Throughput steam injection is more efficient for recovering viscous oil, but usually cannot be applied initially to low permeability formations and many viscous oil formations are not sufficiently permeable to permit steam throughput. Single well bore stimulation by so called steam push-pull processes in which steam is injected into a formation, allowed to remain in contact with the formation for a soak period sufficient to heat the viscous petroleum and reduce its viscosity, followed by reduction in well bore pressure sufficient to cause the heated petroleum to flow back into the well, has been successful in some applications. Problems encountered in push-pull steam stimulation generally are related to the limited penetration of the steam into the formation, with the result that the amount of oil heated sufficiently to permit its recovery from the formation is insufficient to justify the cost of the steam injected into the formation. Injecting higher quality steam, up to and including superheated steam can achieve stimulation of oil production at greater distances from the well, but the cost of generating superheated steam is excessive and other problems are encountered in the use of high quality steam including higher injection pressures per heat unit injected and excessive casing failures.

In view of the above discussed problem and the fact that large quantities of viscous petroleum are known to exist in this country from which little production is being obtained at the present time, and in view of the current urgency to increase our domestic oil production capacity, it can be appreciated that there is a substantial need for a means of operating a single well, push-pull steam stimulation process in a manner which achieves greater in depth stimulation and recovers oil from a large portion of the formation that is currently possible with conventional single well, push-pull steam stimulation techniques.

SUMMARY OF THE INVENTION

The process of my invention concerns an improved single well, push-pull steam stimulation method especially useful in low permeability petroleum formation containing high viscosity petroleum, whereby the rate of production as a consequence of the single well, push-pull steam stimulation process is increased substantially by increasing the quantity of steam that can be injected in a given field situation, and the volume of formation around the well heated as a consequence of injecting steam is increased substantially. My process employs at least one well drilled through the entire viscous oil formation and completed so as to establish two separate communication paths between the surface of the earth and different depths in the formation. It is preferable that one communication path be in fluid communication with the upper portion of the formation, and one other fluid communication path be in fluid communication with the low portion of the formation. It is not essential that the two points of communication be in the upper and lower halves, respectively, of the formation. In a formation having relatively uniform permeability distribution, it is preferred that the communication points be widely separated, and location of one at or near the top and location of the other at or near the bottom, is the preferred method. If there is a zone of very low permeability near the top or bottom of the formation, then the two communication paths should be completed at different depths in the remaining, higher permeability portion of the formation. The formation may be essentially homogeneous, or it may have intervening layers having lesser permeability than the portions of the formation into which steam is injected located between the two completion zones, although the intervening layers between points of fluid communication must not be totally impermeable such as would completely prohibit the passage of steam or other fluid therethrough.

In the first phase of my process, steam is injected into the formation via both fluid flow paths until the injection pressure has increased to a pressure which is considered to be the maximum safe operating value without causing fracturing of the overburden of the viscous oil formation, or to a lesser pressure that is the maximum pressure available from the steam generating equipment. Injection of steam is then terminated into both flow paths, and heated oil is allowed to flow back, via both flow paths, into the well by means of which oil is recovered to the surface of the earth. A soak period may be utilized between the initial steam injection into both zones and production cycle as desired, although it is not essential in this first step. After the oil production rate decreases from the first cycle of thermal stimulation, steam is then injected into only one of the flow paths with the other flow path being initially shut in. Ordinarily it is more effective to inject steam into the bottom to the exclusion of the top portion of the formation, although in some instances it is mechanically simpler to inject steam into the top rather than into the bottom. During the second phase when steam is being injected into one portion of the formation by a means of one flow path, restricted production should be taken from the other portion of the formation by means of the other fluid flow path. This maintains the flow of fluids into the formation via one flow path and out the formation via the other, but results in an increase in the pressure in the formation since fluid injection is at a higher rate than fluid production. By means of this second phase, a pressure differential is created between the upper portion of the formation and the lower portion of the formation. In a preferred embodiment, a third phase is utilized in which the injection-production roles are reversed with respect to the second phase, with steam being injected into the formation by means of the communication path used in the second phase for oil production and oil production being taken from the formation by means of the fluid flow path used in the second phase for steam injection. By means of these selective injections into different depths of the formation with production being taken on a restricted basis from other depths in the formation, the formation is effectively pressure pulsed which achieves a greater in-depth thermal stimulation than could be accomplished with push-pull injection of steam into and production of heated oil from the same depth in the formation on a sequential basis.

The process described above may be utilized with steam of any quality although ordinarily it is preferred that the steam be of a high quality, but at least in the range from about 30 to about 100 percent. Steam only may be injected, or other substances may be combined with the steam to enhance the effectiveness of the steam stimulation process. An especially attractive alternative embodiment involves the injection of a mixture of saturated steam and a light hydrocarbon such as a $C_4$–$C_{10}$ hydrocarbon, or a commercial blend such as natural gasoline, naphtha, etc. When this embodiment is employed, the percentage of hydrocarbon should be from about 1 to about 15 percent on a weight basis.

BRIEF DESCRIPTION OF THE DRAWING

The attached FIGURE illustrates an embodiment of the process of my invention employing a well penetrating a homogeneous, viscous oil formation with the annular space between the casing and a production tubing being utilized for the first fluid flow path which in is communication with the upper portion of the oil formation and the production tubing being utilized as the second flow path which is in fluid communication with the lower portion of the formation.

DESCRIPTION OF THE PREFERRED EMBODIMENT

Briefly, the process of my invention involves a viscous oil recovery method employing steam or a mixture of steam and hydrocarbon or steam and other substances in a process which is a variation of the technique referred to in the art as steam push-pull or "huff and puff" stimulation. The conventional steam push-pull method is one in which steam is injected into a formation to heat viscous petroleum in a portion of the formation adjacent the well used for steam injection, and then the heated petroleum is allowed to flow back into and is produced to the surface via the same well as was used for steam injection. While this type of viscous oil stimulation has been effective in some formations, its effectiveness is relatively limited to the portion of the formation immediately adjacent to the well used for steam stimulation, and as oil is recovered from the portion of the formation near the well and stimulation is directed to portions of the formation more remote from the production well, the efficiency decreases rapidly.

In an effort to increase the cost effectiveness of steam push-pull flooding by extending the distance into the formation which the effect of single well push-pull steam stimulation can be realized, the process of my invention was devised, which permits alternate and/or simultaneous injection into the formation at different depths in a particular production sequence which results in a pressure pulsing effect in the formation. The alternate injection-production sequences recovers petroleum from the portion of the formation immediately adjacent to the well, as well as the conventional steam push-pull process, but additionally extends the distance away from the well, into the formation, where contact between the injected hot fluid and the viscous petroleum is accomplished much further than the conventional single well push-pull technique, and therefore recovers more oil from a single well than would be accomplished by a conventional push-pull process.

The process of my invention is best understood by referring to the attached drawing, in which viscous petroleum formation 1 having relatively uniform fluid permeability is shown. It is not to be inferred, however, that the presence of a lower permeability zone at some point in the formation between the communication depths is detrimental, so long as the vertical permeability of such zones is sufficiently high to permit steam flow therethrough.

In the particular embodiment illustrated in the attached FIGURE, well 2 penetrates the entire oil formation to the bottom thereof. Casing 3 is set to about the mid point of the formation, while production tubing 4 is run to a point near the bottom of the oil formation. Packer 5 is set above the bottom of casing 3, effectively closing off the annular space 6 between tubing 4 and casing 3. Communication means such as perforations or other openings 7 on the lower portion of tubing 4 establishes communication between the surface via tubing 4 and the lower portion of the oil formation. Perforations or other openings 8 in casing 3 complete the communication path between the surface and the upper portion of the oil formation. In the completion technique described, annular space 6 is utilized for fluid communication between the surface and the upper part of the oil formation while production tubing 4 is utilized for communication between the surface and lower portion of the oil formation. The area around the perforations 7 in tubing 4 may be gravel packed or equipped with other permeable material such as is shown in the illustration for the purpose of restraining movement of particles from the portion of the formation with which it is in communication, into the production tubing during the production cycle of the process of my invention. Similar completion techniques should be provided for the communication path in communication with the upper part of the formation, which may employ gravel packing, consolidated sand, screens, or other techniques which are well known in the art and commercially available from oil field service concerns.

It should not be inferred from this description of a preferred embodiment that a completion technique such as is shown in the attached drawing is essential, since other variations may be utilized. Two production tubings may be employed in a single casing, for example, and the annular space in such an embodiment is not utilized for a communication path, but rather the two production tubings are utilized for steam injection and/or oil production, with the communication paths between the appropriate completion interval and the formation face being isolated from each other by means of packers.

In applying the process of my invention to a well completed such as that involved in the attached FIG- URE, a steam generator or other steam source must be located on the surface and connected via suitable pipes equipped with valves so steam may be injected into either the tubing 4 or annular space 6 independently of the other, or simultaneously. Similarly, valving and piping arrangements should be provided so fluid production from either of these flow paths may be accomplished either independently of one another or simultaneously.

In the first phase of the process of my invention, it is usually preferred that steam be injected into all available communication paths to heat all portions of the formation immediately adjacent to the well penetrating the viscous oil formation. In the embodiment illustrated, steam is injected into tubing 4 to pass through opening 7 into the bottom of the oil saturated formation 1, and simultaneously steam is injected into annular space 6 to pass through perforations 8 into the upper portion of oil formation 1. The effect of steam injection in this instance would be to heat the viscous oil contained in both of the intervals. Since the viscosity temperature relationship of most viscous oils is quite sharp, it is usually only necessary to increase the temperature of the viscous petroleum by about 100° F or so, in order to effect a very significant reduction in petroleum viscosity sufficient so that it will flow freely into the well once the pressure gradient is reversed to cause the pressure in the formation to be greater than the pressure in the well bore. In some instances it is desirable to inject for a period of time, usually until the injection pressure has risen to a predetermined value which may be determined by the known maximum safe pressure at which fluid may be injected into the formation 1 without fracturing the formation or overburden above the oil saturated interval, or to a lesser value determined by limits of the steam generating equipment. It is essential to avoid fracturing the overburden which would permit steam to escape to the surface of the earth. After steam has been injected for a predetermined volume or period of time, or until the injection pressure has reached a predetermined value it is usually preferred to shut in the injection well and allow the injected hot fluid to remain in contact with the viscous petroleum and the mineral matrix of the formation for a period of time to achieve a degree of thermal equilibrium between the injected fluid and the formation petroleum adjacent the well. Ordinarily, the soak period in the early phase should be from 5 to about 20 days. It is not absolutely essential that a soak period be used, however, especially in the preliminary treatment in the first phase of the process of my invention.

After steam injection has been terminated, and a soak period, if one is used, is completed, the wells are opened and petroleum is allowed to flow from the formation into both communication paths in the well and to the surface of the earth. Inherent formation pressure, or pressure built up in the formation during the steam injection phase will cause flow of petroleum into the well and no pumping is ordinarily required. Flow may be very rapid at first, but generally declines to a relatively low value after a period of time which may be about the same as the period required for steam injection or it may be less.

After completion of the above described first phase, steam should be injected into only one of the zones by the communication path in communication therewith, while restricted fluid flow is taken from the other zone. For example, steam may be injected into the upper portion of the formation 1 by means of annular space 6 while taking restricted production from the lower portion of the formation by means of the production tubing 4. Production flow rate restriction may be accomplished by use of a choke or a partially closed throttling valve, and the preferred method of employing this embodiment is to restrict the production rate to a value sufficient to maintain the pressure adjacent the openings in the particular communication path utilized for restricted production equal to a value from about 50 to about 90 percent of the pressure at which steam is being injected into the other zone by means of the other fluid communication means.

In another especially preferred embodiment, the rate of flow of fluids from the formation into the well is maintained at a value from 25 to 75 percent of the steam injection flow rate.

Ordinarily, the most effective embodiment of the second phase of the process of my invention involves injecting steam into the lower portion of the formation which would employ production tubing 4 in the embodiment illustrated in the drawing, while taking restricted production from the upper portion of oil formation 1 which would utilize annular space 6 in the illustrated embodiment. In some completion techniques, however, the reverse procedure employing steam injection into the top portion of formation 1 and taking production from the bottom of oil formation 1 is mechanically simpler or preferred for other reasons.

The second phase should be continued for a period of time which is determined by the rate at which steam injection pressure builds up or steam injection rate declines during this phase. Once the pressure at which steam is being injected into the chosen interval has reached the predetermined maximum safe value, steam injection may be continued simultaneously with taking production until it appears that steam and/or steam condensate is being produced from the zone from which production is being taken, which signals the preferred time for termination of this phase of the process.

A natural phenomena plays an important role in achieving the excellent results attainable through the proper application of my invention, especially the increased distance in the formation from which viscous petroleum may be recovered. The vertical permeability of petroleum formations is ordinarily substantially less than the horizontal permeability. In some formations the ratio of horizontal permeability to vertical permeability is as high as 100 to 1.0 or more. Thus steam injected at one depth is not as prone to move vertically to the production depth directly above or below, as it is to move outward into the formation.

In a preferred embodiment, a third phase is utilized in which the injection and production roles utilized in the preceding phase are reversed. For example, if steam injection in the second phase was into the bottom portion of oil formation 1 by use of production tubing 4 with restricted oil production being taken from the upper portion of the formation utilizing annular space 6, the third phase would involve injecting steam into the upper portion of the formation by means of annular space 6 while taking similarly restricted production from the lower portion of the formation by means of production tubing 4.

The above described alternating injection-production cycles should be continued, preferably alternating injecting steam into the upper and lower portions of the formation and similarly taking production from the opposite interval during each injection phase, until further injection of steam into either interval will not accomplish significant stimulated production from either interval. By application of the above-described process, the distance which the push-pull steam stimulation extends into the formation is increased significantly over that possible utilizing a conventional single well push-pull steam stimulation process applied as is taught in the prior art.

The above-described procedures may be employed effectively using steam without any additional additives. In certain formations, even better results can be obtained employing alternative embodiments in which the injection-production sequences are substantially as described above, but the fluid injected is a mixture of steam and certain substances which further promotes recovery of viscous petroleum from the formation.

Certain types of viscous petroleum form low viscosity emulsions spontaneously on contact with steam, which facilitates flow of viscous petroleum into the well. In many applications, emulsification is aided if a small quantity, e.g., from 0.05 to 5.0 percent by weight of an alkaline earth hydroxide such as the hydroxide of sodium, potassium, or lithium, or ammonium hydroxide, is included with the steam injected into the formation.

In another embodiment, from 1 to 15 percent by weight of a $C_4$–$C_{10}$ hydrocarbon including commercial blends of hydrocarbon such as naphtha, natural gasoline, kerosene, etc. is mixed with the steam injected into the formation.

FIELD EXAMPLE

For additional disclosure, and for the purpose of illustrating how the process of my invention may be applied to a typical viscous oil formation, the following field example is supplied. It is not intended to be in any way limitative or restrictive of the process of my invention, however, since it is offered only for the purpose of additional disclosure.

A viscous oil formation is located at a depth from 1825 feet to 1937 feet. The formation is determined to be composed of three distinct intervals, all of which contain oil, but which have detectable differences in permeability. The upper interval, which has an average thickness of 50 feet, contains 9° API crude and the average horizontal permeability of the upper interval is determined to be 1700 millidarcies. The average thickness of the middle interval is 22 feet. The oil saturation in this interval is 70 percent, as compared to 50 percent of the upper interval. The horizontal permeability of the central interval is 400 millidarices. The average thickness of the lowest interval in the formation is 40 feet, and it is determined that this lower interval has an average oil saturation of 60 percent and the horizontal permeability is about 1000 millidarcies. The API gravity of the crude oil is about the same in all three intervals. The vertical permeability throughout each interval of the formation averages about 10 percent of the horizontal permeability in that interval.

A well is drilled to the bottom of the lowest interval, and a casing is set to the bottom of the central interval. Perforations are made in the upper half of the top interval in the casing and a packer is set near the bottom of the casing so the annular space between the production tubing and the casing establishes a fluid communication path between the surface and the upper part of the top interval. A slotted liner is included on the bottom 30 feet of the production tubing, and gravel is packed into the open hole around the slotted liner to restrain movement of sand thereinto, thereby establishing fluid communication by means of the production tubing between the surface and the bottom 30 feet of the lowest interval in the oil formation.

A steam generator is located near the well and connections are made with separate valves to both the production tubing and the annular space. The well completion is such that steam may be injected into either the production tubing or the annular space independent of the other, or it may be injected into both simultaneously. Similarly, production may be taken from either the tubing or annular space separately or simultaneously.

Eighty percent quality is injected into both the tubing and annular space at the maximum output of the generator initially, and the pressure is monitored carefully. It is determined that the maximum safe injection pressure is 1500 pounds whereas the maximum output of the steam generator is 700 pounds per square inch. Steam is injected at the maximum rate and the injection pressure gradually increases over a period of about 9 days until the injection pressure has risen to a value about equal to the maximum output of the steam generator. Steam injection is then terminated, and the wells are shut in for 7 days in order to allow the steam to "soak" or remain in the formation to obtain the maximum transfer of thermal energy from the injected fluids to the viscous oil and formation matrix. After the soak period is completed, both intervals are opened and production of heated petroleum is taken from both intervals with flow rate restriction only as is required to protect the mechanical equipment in the well. A choke is utilized in both flow streams for this purpose. The production rate decreases with time, and after about 20 days the flow of petroleum from the formation has decreased and the water-oil ratio has increased to a point where it appears further fluid production is not justified.

The second phase of the process is then initiated, in which steam is injected by means of the production tubing into the bottom portion of the formation at the maximum injection rate obtainable at the available pressure as was done in the first phase initially. Production is taken from the upper interval by means of the annular space, but the flow rate is restricted by use of a choke to about half of the injection rate in barrels per day, which permits a gradual increase of pressure in the upper interval during this phase of the process. This phase of injection into the bottom interval and taking restricted production from the top interval is continued for about 14 days after which steam and steam condensate are being produced from the upper interval, at which time this phase is terminated.

For the next phase of the process of my invention, the connections on the surface are reversed, and steam is thereafter injected into the upper portion of the formation by means of the annular space and restricted production is taken from the bottom portion of the formation in a manner similar to that described above, again until the presence of steam and steam condensate in the produced fluid signals that the maximum effectiveness of this phase of the process has been obtained.

The process is continued, using alternating cycles of steam injection into the upper or lower portion of the formation and taking restricted production from the other followed by reversal of the injection production sequences until no further oil production can be obtained from the well.

Thus I have disclosed how it is possible to alternately inject steam into one interval and take restricted production from another interval so as to pressure pulse the formation, by means of which the effectiveness of steam push-pull stimulation of viscous oil formations can be increased substantially over that obtainable using a single well push-pull process. While my invention has been described in terms of a number of illustrative embodiments, it not so limited since many variations thereof will be apparent to persons skilled in the art of enhanced oil recovery without departing from the true spirit and scope of my invention. It is my desire and intention that my invention by limited only by those restrictions and limitations as appear in the claims appended hereinafter below.

I claim:

1. A method for recovering viscous petroleum from a subterranean, permeable, viscous petroleum-containing formation comprising:

(a) penetrating the formation with at least one well and establishing within the well two separate fluid flow paths from the surface of the earth, the first path being in fluid communication with at least a portion of the upper part of the oil formation and the second flow path being in fluid communication with at least a portion of the lower part of the formation;

(b) injecting a heated thermal recovery fluid comprising steam into both the upper and lower portions of the formation via both communication paths for a predetermined period of time;

(c) producing heated petroleum from both the upper and lower portions of the formation via both of the communication paths;

(d) thereafter injecting the heated thermal recovery fluid comprising steam into one portion of the formation by means of one of the fluid communication paths at a known or determinable rate and pressure;

(e) simultaneously recovering petroleum at a predetermined rate which is substantially less than the injection rate of step (d) from the other part of the formation by means of the other communication path until the pressure adjacent the production zone rises to a value which is from 50 to 90 percent of the pressure at which the thermal fluid is being injected in step (d);

(f) continuing producing petroleum and injecting steam until steam or steam condensate production occurs at the part of the formation from which petroleum is being produced in step (e);

(g) thereafter discontinuing step (f);

(h) thereafter injecting the heated thermal recovery fluid into the interval from which oil production was taken in step (e) at a known or determinable rate and pressure; and (i) recovering petroleum from the zone into which steam was injected in step (d) at a restricted rate which is less than the injection rate of step (h) until the pressure adjacent the production zone reaches a value from 50 to 90 percent of the heated thermal recovery fluid injection pressure; and (j) continuing producing petroleum in step (i) until steam or steam condensate is produced with petroleum.

2. A method as recited in claim 1 wherein the flow of fluid from the formation in step (e) is restricted to a value from about 25 to about 75 percent of the fluid injection rate of step (d).

3. A method as recited in claim 1 wherein continuing cycles of injecting steam into one portion of the formation and taking reduced production from the other part of the formation are applied, alternating the communication path used for steam injection and oil production from one cycle to the next.

4. A method as recited in claim 1 wherein the thermal recovery fluid comprises a mixture of steam and a light hydrocarbon.

5. A method as recited in claim 4 wherein the light hydrocarbon is selected from the group consisting of $C_4$ to $C_{10}$ aliphatic hydrocarbons, natural gasoline, naphtha, and mixtures thereof.

6. A method as recited in claim 1 wherein step (e) is continued until live steam is recovered from the formation along with petroleum being produced from the other communication path according to step (e).

7. A method as recited in claim 1 wherein steam injection in step (d) is into the lower part of the formation via the second flow path and petroleum is recovered from the upper part of the formation via the first flow path.

8. A method as recited in claim 7 comprising the additional steps, after completion of producing oil from the upper portion of the formation via the first flow path, of injecting steam into the upper portion of the formation via the first flow path and recovering petroleum from the lower portion of the formation via the second flow path.

9. A method as recited in claim 1 comprising the addition step of leaving the steam injected into the formation in step (b) in the formation for a soak period of from 5 to 20 days prior the oil production in step (c).

10. A method as recited in claim 1 wherein the thermal recovery fluid comprises steam and from 0.05 to 5.0 percent by weight sodium hydroxide, lithium hydroxide, potassium hydroxide, ammonium hydroxide or mixtures thereof.

* * * * *